US009065186B2

(12) United States Patent
Perrin

(10) Patent No.: US 9,065,186 B2
(45) Date of Patent: Jun. 23, 2015

(54) MICROWAVE COAXIAL CONNECTOR, INTENDED NOTABLY TO LINK TWO PRINTED CIRCUIT BOARDS TOGETHER

(71) Applicant: RADIALL, Aubervilliers (FR)

(72) Inventor: Yves Perrin, Saint Nicolas de Macherin (FR)

(73) Assignee: RADIALL, Aubervillies (FR)

( * ) Notice: Subject to any disclaimer, the term of this patent is extended or adjusted under 35 U.S.C. 154(b) by 0 days.

(21) Appl. No.: 14/183,842

(22) Filed: Feb. 19, 2014

(65) Prior Publication Data

US 2014/0235100 A1 Aug. 21, 2014

(30) Foreign Application Priority Data

Feb. 19, 2013 (FR) ..... 13 51394

(51) Int. Cl.

| | |
|---|---|
| ***H01R 12/00*** | (2006.01) |
| ***H01R 9/05*** | (2006.01) |
| ***H01R 24/52*** | (2011.01) |
| ***H01R 13/24*** | (2006.01) |
| ***H01R 24/50*** | (2011.01) |
| *H01R 105/00* | (2006.01) |

(52) U.S. Cl.

CPC ..... *H01R 9/0527* (2013.01); *H01R 24/52* (2013.01); *H01R 2105/00* (2013.01); *H01R 13/24* (2013.01); *H01R 13/2442* (2013.01); *H01R 24/50* (2013.01); *H01R 9/0515* (2013.01)

(58) Field of Classification Search

CPC ..... H01R 24/50; H01R 9/0515; H01R 24/52; H01R 13/2442; H01R 9/0527; H01R 13/24; H01R 2105/00

USPC ..... 439/578, 63, 591, 862

See application file for complete search history.

(56) References Cited

U.S. PATENT DOCUMENTS

| | | | | |
|---|---|---|---|---|
| 4,737,123 | A * | 4/1988 | Paler et al. | 439/607.18 |
| 7,416,418 | B2 | 8/2008 | Berthet et al. | |
| 2003/0060069 | A1 * | 3/2003 | Duquerroy et al. | 439/188 |
| 2010/0159718 | A1 * | 6/2010 | Duquerroy et al. | 439/66 |
| 2014/0030915 | A1 | 1/2014 | Perrin | |

FOREIGN PATENT DOCUMENTS

| | | |
|---|---|---|
| DE | 10 2005 033 911 A1 | 2/2007 |
| FR | 2 994 031 | 1/2014 |

* cited by examiner

*Primary Examiner* — Neil Abrams
*Assistant Examiner* — Travis Chambers
(74) *Attorney, Agent, or Firm* — Oliff PLC

(57) ABSTRACT

The present invention relates to a novel microwave coaxial connector that allows for a board-to-board connection over a very short distance, typically less than or equal to 2 mm, with relatively high tolerances in relative value terms but low tolerances in absolute value terms, typically equal to 0.2 mm, and at the same time ensuring a good electrical contact between all the tracks of the printed circuits to be connected.

12 Claims, 3 Drawing Sheets

MICROWAVE COAXIAL CONNECTOR, INTENDED NOTABLY TO LINK TWO PRINTED CIRCUIT BOARDS TOGETHER

The present invention relates to a microwave coaxial connector. Such a connector is intended notably to link two printed circuit boards or even a printed circuit board to another component such as a module or a filter.

A "microwave connector" should be understood, here and in the context of the present invention, to mean a connector capable of ensuring the transmission of signals in the microwave range, for example at frequencies of between 1 GHz and 20 GHz.

A "contact" should be understood, here and in the context of the present invention, to mean an element made of electrically conductive material for allowing the electrical current to pass.

By contrast, an "insulating element" is an element made of electrically insulating material.

To establish a coaxial link between two printed circuit boards that are parallel and close to one another, coaxial connectors are known that comprise a first cylindrical connector element intended to be fastened, by one end, to a first printed circuit board, and a second cylindrical connector element intended to come into contact, by one end, with a second printed circuit board, each connector element comprising a central contact and an outer contact separated by an insulator, the central and outer contacts of the first and second connector elements comprising cylindrical bearing surfaces mutually in contact, elastic means being interposed between the first and second connector elements and stressing the central and outer contacts of the second connector element towards the second printed circuit board.

The first connector element can be fastened mechanically, notably by brazing, to the first printed circuit board and the second board is brought to bear against the second connector element which is displaced relative to the first connector element, the contacts of the second connector element being pressed under the action of the elastic means against the conductive zones provided on the second board. Thus, these elastic means are necessary to obtain a sufficient mechanical contact force, guaranteeing a good electrical contact.

Auxiliary means ensure that the second printed circuit board is held in position in proximity to the first printed circuit board, thus preventing the second connection element from being disconnected from the first connection element and from the second printed circuit board.

A connector of this type in which the elastic means are O-ring seals made of elastomer is described in the patent U.S. Pat. No. 6,699,054. The addition of O-ring seals makes the design of this connector complex.

The patent application DE 102005033911 discloses a connector in which the elastic means consist of a central helical spring which also constitutes the central contact. A major drawback is that one of the ground contacts in the form of a solid cylinder is not really compressible, which does not guarantee a good ground electrical contact and absorbing relatively great board-to-board tolerances. Furthermore, the central spring induces an excessive inductance, unsuited to the transmission of microwave signals.

The patent U.S. Pat. No. 7,416,418 discloses a so-called board-to-board microwave coaxial connector, in which a first spring is axially inserted between the conductive rods of the connection elements. A second spring is inserted axially between the conductive bodies of the connection elements. The first connector element is fastened to the first printed circuit board. When the second printed circuit board is brought against the second connection element, the springs push back the rod and the body of the second connector element against the second printed circuit board, opposite the first connector element, so as to ensure a satisfactory electrical contact between the second connector element and the second printed circuit board. The structure of this connector is still relatively complex, in particular given the use of springs.

To overcome the drawback linked to the use of the two springs of the patent U.S. Pat. No. 7,416,418, the applicant has proposed, in the patent application FR 1257333, a novel microwave coaxial connector of more simple structure.

In addition to the abovementioned drawbacks, the known coaxial connectors have a height which remains relatively great in their connection position, which, de facto, induces a lower limit on the distance to which the two printed circuit boards can be brought close to one another, which still remains relatively great.

Now, the inventors were faced with a need for a microwave coaxial connector for linking two printed circuit boards, separated by a very small board-to-board distance, typically less than 1.5 mm, with relatively high tolerances in relative value terms but low tolerances in absolute value terms, typically equal to 0.2 mm.

The invention aims to address all or part of this need.

Thus, the subject of the invention, according to one of its aspects, is a microwave coaxial connector, intended notably to link two printed circuit boards together, wherein it comprises:

- a first outer contact comprising a body of generally tubular form of longitudinal axis X, comprising a first end, a second end opposite the first end, and, on its outer periphery, between the first and second ends, a contact surface of flared form towards the second end,
- a central contact comprising an elongate conductive element partly folded on itself defining an elastically deformable loop which can be closed, with one of its free ends outside of the loop,
- a second outer contact comprising an elastically deformable open ring,
- an insulating element comprising an open slot that is elongate on the axis X, the insulating element being arranged between the elongate conductive element and the tubular body, in that the elongate conductive element inside the insulating element is such that its loop can be closed and elastically deformed by compression on itself between a non-deformed position in which its top protrudes beyond the first end and an extreme deformed position in which its top is aligned on the first end, the free end of the elongate conductive element outside of the loop being able to slide by protruding from the slot so as to be aligned on the second end regardless of the deformed position of the loop, and in that the ring is kept outside the tubular body so that it can be elastically deformed by pressing against the flared surface between a non-deformed position in which it is not pressing against the flared surface and its top protrudes beyond the first end and an extreme deformed position in which its top is aligned on the first end.

According to an advantageous variant embodiment, the elongate conductive element is a blade.

A "blade" should be understood, here and in the context of the invention, in the usual technological sense of the term, i.e. a thin and narrow strip of metal.

According to another variant, the elongate conductive element is a wire of small diameter, whose mechanical characteristics satisfy the required mechanical deformation requirements.

Preferably, the blade has a thickness of between 0.05 and 0.15 mm and a width of between 0.4 and 1 mm. By way of example, a blade based on copper beryllium $CuBe_2$ 0.07 mm thick for a width of 0.6 mm is perfectly suitable for producing the invention.

A "surface of flared form towards the second end" should be understood, here and in the context of the invention, to mean a surface which widens continually towards the second end. In other words, the contact surface is a surface either of tapered form, or convex relative to the axis of the connector and increases in diameter towards the second end of the tubular body.

An "open ring" should be understood, here and in the context of the invention, in the usual technological sense of the term, i.e. a slotted or a retaining ring split at a point of its circumference over its entire width.

"Top" should be understood, here and in the context of the invention, to mean the end of the elongate conductive element or the end of the ring furthest away from the body in its non-deformed position.

By virtue of the invention, it is possible to produce a board-to-board connection over a very short distance, typically less than or equal to 2 mm, with tolerances that are relatively high in relative value terms but low in absolute value terms, typically equal to 0.2 mm, and at the same time guaranteeing a good electrical contact between all the tracks of the printed circuits to be connected.

In practice, by employing a single central contact which can be deformed, the minimum height of the connector according to the invention is defined solely by the height of the rigid tubular body of the ground contact which can easily be made very small.

The elastic deformations both of the ring and of the elongate conductive element make it possible to totally absorb the distance tolerances between boards and, by their elastic return, to guarantee quality electrical contacts.

Furthermore, the inventors have been able to observe that the fact of ensuring the closure of the loop affords a relatively low inductance, which is advantageous in the transmission of microwave signals.

The "board-to-board" mounting using a coaxial connector according to the invention can be performed without prior securing of the connector with one and/or other of the printed circuit boards, or with prior securing notably by brazing of the first outer conductive body to one of the boards, preferably the bottom one. Specified here, obviously, the means for prior securing of the connector to one and/or other of the boards are clearly distinct from the mechanical securing means making it possible to maintain the distance between boards in order to retain the electrical connection.

According to an advantageous embodiment, the connector comprises at least one protuberance protruding into the insulating element inside the closed loop to keep the elongate conductive element inside the insulating element regardless of the deformed or non-deformed position of the loop.

According to an advantageous variant, the protuberance(s) is (are) produced by cold deformation of the constituent material of the insulating element. Thus, according to this variant, it is sufficient to produce one or more pits in the insulating material, or, in other words, one or more indentations therein, to obtain the definitive securing of the elongate conductive element. The prior insertion of the free end of the elongate conductive element allows the latter to be temporarily secured in the insulator before the pit or pits are produced. No additional fastening means is necessary, which reduces the number of parts. This is all the more advantageous for a connector according to the invention with short board-to-board distances to be connected.

Preferably, the insulating element is made of polyetheretherketone (PEEK). In addition to its very good electrical insulation properties, PEEK has the advantage of being able to be moulded and machined easily, which is advantageous for the production of the insulating element according to the invention.

According to an advantageous variant embodiment, the insulating element is kept inside the tubular body, preferably by force-fitting, and the free end of the elongate conductive element outside of the loop is able to slide in the slot so as to be aligned on the second end regardless of the deformed position of the loop. Instead of securing the insulating element inside the tubular body by force-fitting, securing by snap-fitting can be provided.

Preferably, the insulating element is held inside the tubular body so that its end opposite the open slot is aligned on the first end of the body.

According to an alternative variant, the insulating element is mounted inside the tubular body with an axial play on the axis X, and the free end of the elongate conductive element outside of the loop is fixed in the slot so as to be aligned on the second end regardless of the deformed position of the loop.

According to another advantageous variant, the open ring comprises, on its inner periphery, a groove defining an abutment shoulder and the tubular body also comprises, on its outer periphery, between its first end and its flared surface, an abutment shoulder, the shoulders of the ring and of the tubular body cooperating by mutual abutment to keep the ring outside the tubular body in its non-deformed position.

The open ring can have a constant section over its entire periphery or have a variable section over the periphery. An advantageous variant embodiment consists in providing a section which decreases towards the opening (slot) of the ring. The electrical contact can thus be made uniform over the entire periphery of the ring in its capacity as second outer contact.

Preferably, the flared surface is of tapered form or in the form of a circular arc.

According to an advantageous feature, the elongate conductive element and the ring are based on copper beryllium ($CuBe_2$).

Advantageously, the clearance (H0-Hm) between the non-deformed position and the extreme deformed position both of the ring and of the elongate conductive element is between 0.1 and 0.4 mm.

Also advantageously, the height of the tubular body, measured between the first and the second ends, is less than 2 mm.

Also the subject of the invention, according to another of its aspects, is a method for producing a microwave coaxial connector as has just been described, according to which the following steps are performed:

a/ mounting with holding of the elongate conductive element of the central contact inside the insulating element, with prior insertion of the free end into the open slot and with formation at least partly of the closed loop;

b/ mounting of the insulating element in which the elongate element is held, inside the tubular body of the first outer contact;

c/ mounting with holding of the open ring as second outer contact around the tubular body;

d/ final production of the closed loop such that it can be deformed to its extreme position aligned on the first end of the tubular body and sliding of the free end outside of the loop until it is aligned on the second end of the tubular body protruding from the insulating element.

The steps b/ and c/ can be carried out in succession or in reverse order.

When producing the insulating element, a check is performed to ensure that the height of the open slot in the insulating element, that is to say its dimension on the axis X of the connector, is sufficient to avoid any pivoting and/or folding of the elongate conductive element once the latter with its free end is aligned on the second end of the tubular body forming the ground contact. In other words, the height of the slot in the insulating element is sufficient to ensure that the free end of the elongate conductive element is secured and can slide, outside of the loop and without plastic deformation of the free end.

The step a/ is preferably performed by at least partially forming the loop with prior insertion of a free end into the open slot of the insulating element, followed by the production of pits, typically two of them, facing one another, in the insulating material and inside the loop to secure the latter in the insulating element. In this embodiment, a sufficient play j is provided between a portion of the loop and the insulating element to ensure that there is no mechanical contact between them.

The step b/ is preferably performed with the insulating element secured inside the tubular body, advantageously by force-fitting of the insulating element in the tubular body.

The step c/ is preferably performed by simply widening the ring beyond the diameter of the abutment shoulder of the tubular body then reclosing the ring so as to have its shoulder defined by the groove brought into mutual abutment against the abutment shoulder of the body.

The step d/ is advantageously performed by simple compression of the loop on itself in order to reclose it.

A final subject of the invention, according to yet another of its aspects, is an electrical circuit assembly comprising:

at least one microwave coaxial connector as described previously, two printed circuit boards held parallel to one another by a given distance, each of the boards comprising a first conductive track, called central track, and a second conductive track, called ground track, in which the connection between the central tracks is produced by the elongate conductive element with its closed loop in any deformed position up to its extreme deformed position, while the connection between the ground tracks is produced by the ring in any deformed position up to its extreme deformed position.

Other advantages and features of the invention will become more apparent on reading the detailed description of exemplary implementations of the invention, given as illustrative and nonlimiting examples with reference to the following figures in which.

Figure 1:
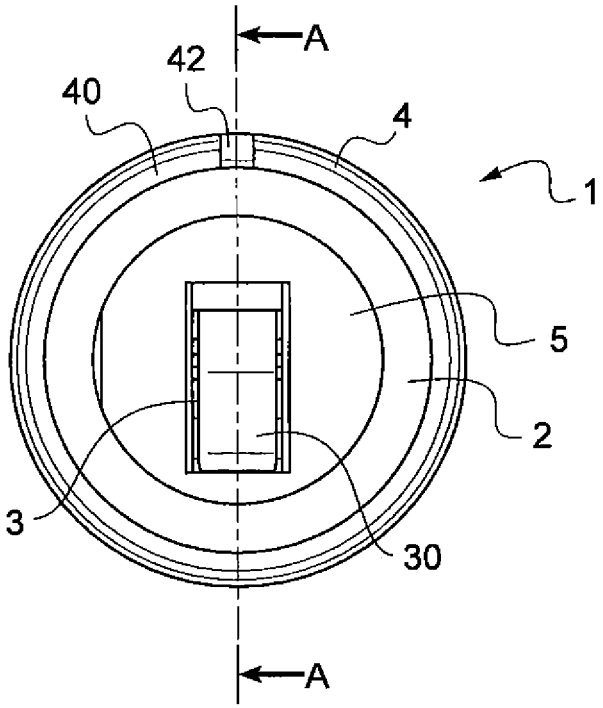
FIG. 1 represents a plan view of an exemplary microwave coaxial connector according to the invention.
Figure 1A:
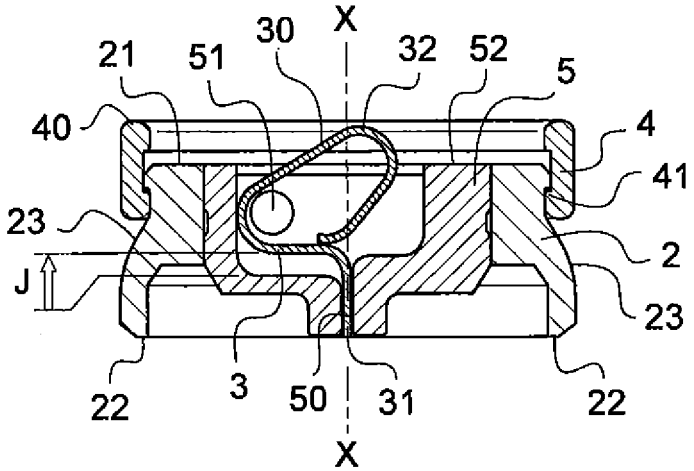
FIG. 1A is a longitudinal cross-sectional view of the connector according to FIG. 1.

Throughout the present application, the terms "vertical", "bottom", "top", "low", "high", "below", "above" and "top" should be understood by reference to a microwave coaxial connector in vertical configuration with the first end 21, i.e. the top end, of the body 2 above the second end 22, i.e. the bottom end.

A coaxial connector 1 according to the invention which will be described is able to convey microwave signals, that is to say signals in the range of frequencies between 1 GHz and 20 GHz.

FIG. 1 shows an exemplary microwave coaxial connector 1 according to the invention.

A microwave coaxial connector 1 according to the invention is provided to link two printed circuit boards 6, 7, separated by a very small board-to-board distance, typically less than 1.5 mm, with tolerances that are relatively high in relative value terms, typically equal to 0.2 mm.

Figure 2:
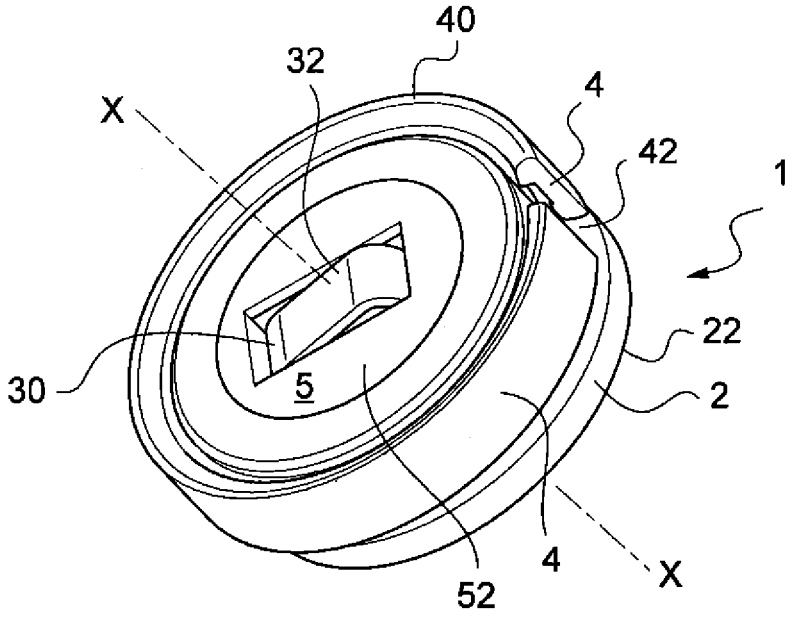
FIG. 2 is a perspective view from above of the connector according to FIG. 1.
Figure 3:
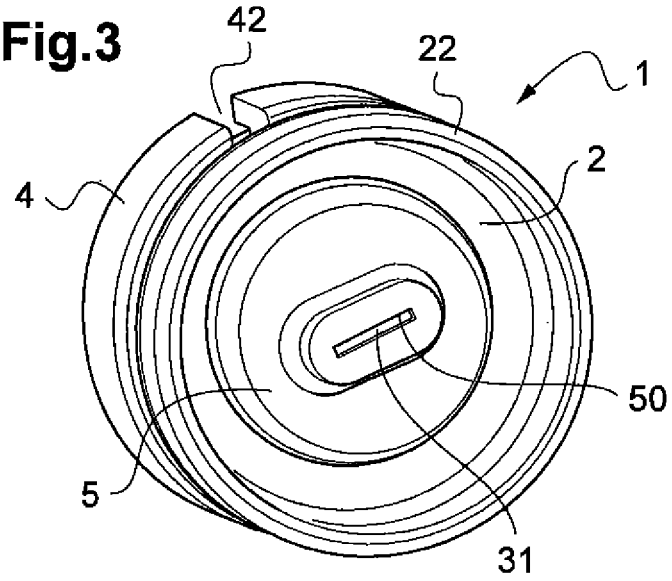
FIG. 3 is a view from below of the coaxial connector according to FIG. 1.

In all the connected together configurations of the two boards 6, 7, such as those illustrated in FIGS. 2B, 4 and 5, mechanical securing means which are not represented and distinct from the microwave coaxial connector 1 according to the invention ensure that the two boards 6, 7 connected together are kept at a distance.

As illustrated, a microwave coaxial connector 1 according to the invention consists of four parts, namely two outer contacts 2, 4 which form ground contacts, a central contact 3 and an electrically insulating element 5.

Thus, the microwave coaxial connector 1 according to the invention comprises first of all, as first outer contact, a rigid tubular body 2, of revolution about a longitudinal axis X.

This body 2 comprises a top end 21, a bottom end 22 opposite the top end, and, on its outer periphery, between the top end 21 and the bottom end 22, a contact surface 23 of a form that is flared in a circular arc towards the bottom end 22. The body 2 is pierced on either side and thus has a plurality of internal circular sections including one 2*a* of constant section from the top end 21. The body 2 also comprises an abutment shoulder 24 between its top end 21 and the flared contact surface 23.

The microwave coaxial connector 1 also comprises a central contact comprising a blade 3 partly folded on itself defining a closed loop 30, elastically deformable, with one of its free ends 31 outside of the loop.

The microwave coaxial connector 1 also comprises, as second outer contact an elastically deformable open ring 4. This open ring 4, or slotted ring, defines a slot 42 thereof. Internally, it comprises a groove defining an abutment shoulder 41. In the embodiment illustrated, the section of the open ring 4 is constant over its entire periphery. As a variant, it would be possible to provide a variable section with a reduction in proximity to the slot 42, which makes it possible to make the electrical contact uniform between the ring 4 and the conductive tracks of the board or electronic component on which it bears.

The microwave coaxial connector 1 according to the invention finally comprises an insulating element 5 comprising an open slot 50 that is elongate on the axis X, the insulating element being arranged between the blade 3 and the tubular body 2. More specifically, as illustrated in all the figures, the insulating element 5 is secured by force-fitting into the tubular body 2.

The blade 3 and the open ring 4 are preferably based on copper beryllium ($CuBe_2$). The insulating element 5 is preferably made of polyetheretherketone PEEK.

As an example, the blade 3 has a thickness equal to 0.07 mm for a width of 0.6 mm.

Also by way of example, the inner diameter of the bottom end 22 of the body 2 is equal to 3.3 mm while the outer diameter of this bottom end is equal to 3.5 mm.

As illustrated, the mounting of the different elements 2, 3, 4, 5 of the coaxial connector 1 according to the invention is designed such that:

on the one hand, the blade 3 is secured inside the insulating element 5 in such a way that the closed loop 30 can be deformed elastically by compression on itself between a non-deformed position (FIGS. 1, 1A, 2, 3 to 3B and 4A) in which its top 32 protrudes beyond the top end 21 of the body 2 and an extreme deformed position in which its top 32 is aligned on the top end, the free end 31 of the blade 3 outside of the loop being able to slide in the slot 50 by protruding therefrom and by being aligned on the bottom end 22 regardless of the deformed or non-deformed position of the loop.

on the other hand, the ring 4 is secured outside the tubular body 2 in such a way that it can be deformed elastically by pressing against the surface that is flared in the form of a circular arc 23 between a non-deformed position (FIGS. 1, 1A, 2, 3 and 4A) in which it is not pressing against the flared surface and its top 40 protrudes beyond the top end 21 and an extreme deformed position in which its top 40 is aligned on the top end 21.

Figure 4A:
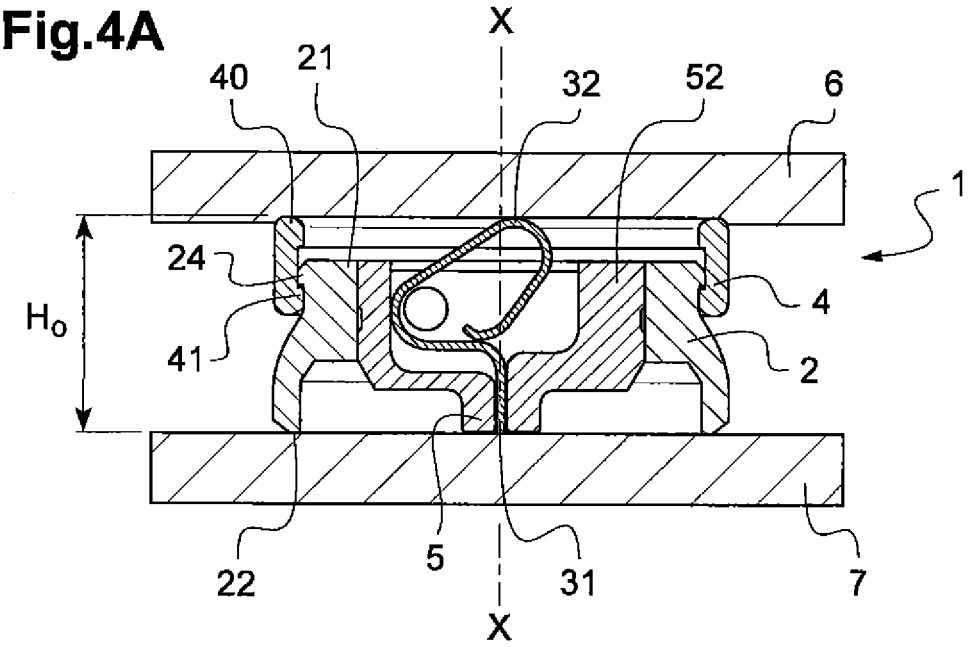
FIGS. 4A and 4B show a longitudinal cross-sectional view of the microwave coaxial connector according to FIG. 1 between two printed circuit boards to be connected, respectively in the non-connected configuration and the connected configuration.

FIG. 4A represents the non-deformed positions of the blade 3 and of the open ring 4, the coaxial connector 1 also being positioned on the bottom board 7 of the two printed circuit board 6, 7 to be linked together and the other board 6 being positioned above the connector 1.

In this non-connected configuration, the positioning of the coaxial connector 1 is ensured in such a way as to have the free end 31 of the blade 3 positioned in contact with a conductive track 70, called central track, and the bottom end 22 in contact with a conductive track 71, called ground track, of the board 7.

Moreover, in this configuration, the open ring 4 is kept by its abutment shoulder 41 in mutual abutment against the abutment shoulder 24 of the body 2. The loop closed partly on itself is, for its part, held by two pits 51 facing one another, produced by cold deformation in the constituent insulating material of the insulating element 5.

Figure 4B:
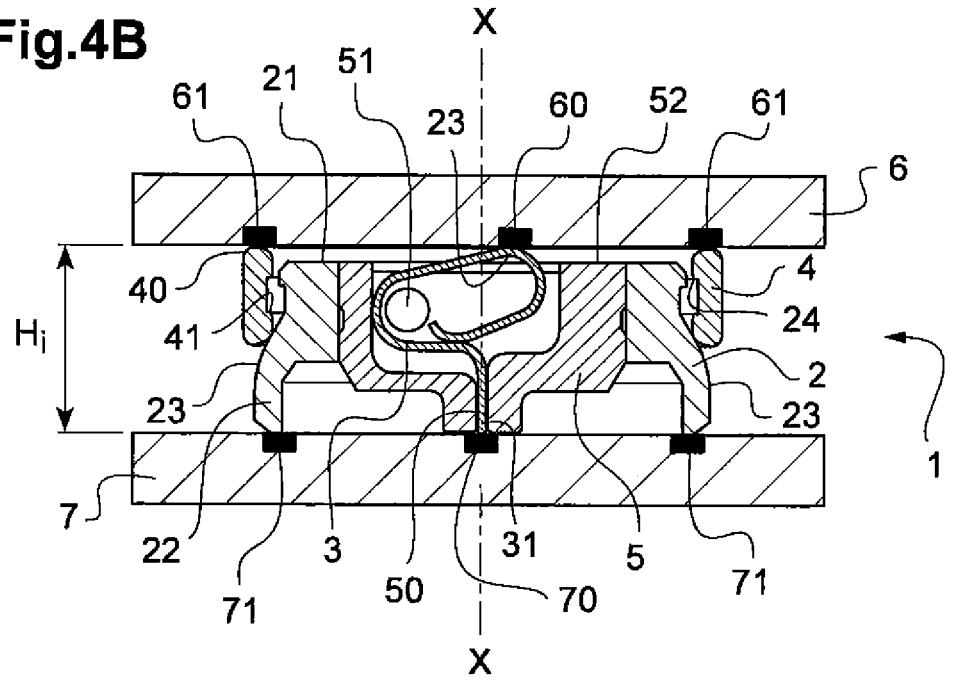

FIG. 4B represents the intermediate deformed position both of the blade 3 and of the open ring 4.

In this configuration with the two boards 6, 7 connected together by the coaxial connector 1 according to the invention, the free end 31 of the blade 3 and the bottom end 22 of the body remain in contact respectively with the central track 70 and the ground track 71 of the bottom board 7, while the top 32 of the closed loop 30 of the blade 3 is in contact with the central track 60 of the top board 6 and the top 40 of the ring 4 is in contact with the ground track 61 of the top board.

In their extreme deformed positions which are not represented, the tops 32, 40 respectively of the blade 3 and of the open ring 4 are aligned on the top end 21 of the body 2.

As illustrated in FIG. 4A, the height H0 represents the maximum distance between the tops 32 and 40 respectively of the blade 3 and of the open ring 4 in their non-deformed positions. The height Hi represents an intermediate connection distance between the two printed circuit boards 6, 7. Advantageously, the clearance (H0-Hm) between the non-deformed position and the extreme deformed position both of the ring and of the blade is between 0.1 and 0.4 mm.

By way of example, the height H0 is of the order of 1.7 mm and the height Hm is close to 1.3 mm.

The axial contact force on the axis X by elastic return both of the blade 3 and of the open ring 4 ensures a good electrical contact respectively with the central tracks 60, 70 and the ground tracks 61, 71 of the two printed circuit boards 6, 7.

Other variants and enhancements can be provided without in any way departing from the framework of the invention.

The expression "comprising one" should be understood to be synonymous with "comprising at least one", unless otherwise specified.

The invention claimed is:

1. Microwave coaxial connector, intended notably to link two printed circuit boards together, wherein it comprises:

a first outer contact comprising a body of generally tubular form of longitudinal axis X comprising a first end, a second end opposite the first end, and, on its outer periphery, between the first and second ends, a contact surface of flared form towards the second end, a central contact comprising an elongate element partly folded on itself defining an elastically deformable loop which can be closed, with one of its free ends outside of the loop, a second outer contact comprising an elastically deformable open ring an insulating element comprising an open slot that is elongate on the axis X, the insulating element being arranged between the elongate conductive element and the tubular body, in that the elongate conductive element inside the insulating element is such that its loop can be closed and elastically deformed by compression on itself between a non-deformed position in which its top protrudes beyond the first end and an extreme deformed position in which its top is aligned on the first end, the free end of the elongate conductive element outside of the loop being able to slide by protruding from the slot so as to be aligned on the second end regardless of the deformed position of the loop, and in that the ring is kept outside the tubular body so that it can be elastically deformed by pressing against the flared surface between a non-deformed position in which it is not pressing against the flared surface and its top protrudes beyond the first end and an extreme deformed position in which its top is aligned on the first end.

2. Microwave coaxial connector according to claim 1, wherein the elongate conductive element is a blade.

3. Microwave coaxial connector according to claim 1, wherein the insulating element is mounted inside the tubular body with an axial play on the axis X, and in that the free end of the elongate conductive element outside of the loop is fixed in the slot so as to be aligned on the second end regardless of the deformed position of the loop.

4. Microwave coaxial connector according to claim 1, wherein the open ring comprises, on its inner periphery, a groove defining an abutment shoulder and the tubular body also comprises, on its outer periphery, between its first end and its flared surface, an abutment shoulder, the shoulders of the ring and of the tubular body cooperating by mutual abutment to keep the ring outside the tubular body in its non-deformed position.

5. Microwave coaxial connector according to claim 1, wherein the flared surface is of tapered form or in the form of a circular arc.

6. Microwave coaxial connector according to claim 1, wherein the height of the tubular body, measured between the first and the second ends, is less than 2 mm.

7. Method for producing a microwave coaxial connector according to claim 1, according to which the following steps are performed:

a/ mounting with holding of the elongate conductive element of the central contact inside the insulating element, with prior insertion of the free end into the open slot and with formation at least partly of the closed loop;

b/ mounting of the insulating element in which the elongate element is held, inside the tubular body of the first outer contact;

c/ mounting with holding of the open ring as second outer contact around the tubular body;

d/ final production of the closed loop such that it can be deformed to its extreme position aligned on the first end of the tubular body and sliding of the free end outside of the loop until it is aligned on the second end of the tubular body protruding from the insulating element.

8. Electrical circuit assembly comprising:

at least one microwave coaxial connector according to claim 1, two printed circuit boards held parallel to one another by a given distance, each of the boards comprising a first conductive track, called central track, and a second conductive track, called ground track, in which the connection between the central tracks is produced by the elongate conductive element with its closed loop in any deformed position up to its extreme deformed position, while the connection between the ground tracks is produced by the ring in any deformed position up to its extreme deformed position.

9. Microwave coaxial connector according to claim 1, wherein it comprises at least one protuberance protruding into the insulating element, inside the closed loop, to keep the elongate conductive element inside the insulating element regardless of the deformed or non-deformed position of the loop.

10. Microwave coaxial connector according to claim 9, wherein the protuberance(s) is (are) produced by cold deformation of the constituent material of the insulating element.

11. Microwave coaxial connector according to claim 1, wherein the insulating element is kept inside the tubular body, preferably by force-fitting, and in that the free end of the elongate conductive element outside of the loop is able to slide in the slot so as to be aligned on the second end regardless of the deformed position of the loop.

12. Microwave coaxial connector according to claim 11, wherein the insulating element is held inside the tubular body so that its end opposite the open slot is aligned on the first end of the body.

* * * * *